US010926567B2

(12) United States Patent
Peleman

(10) Patent No.: US 10,926,567 B2
(45) Date of Patent: Feb. 23, 2021

(54) METHOD FOR BINDING A BUNDLE OF LEAVES

(71) Applicant: PELEMAN INDUSTRIES, NAAMLOZE VENNOOTSCHAP, Puurs (BE)

(72) Inventor: Guido Frans M. Peleman, Knokke-Heist (BE)

(73) Assignee: PELEMAN INDUSTRIES, NAAMLOZE VENNOOTSCHAP, Puurs (BE)

( * ) Notice: Subject to any disclaimer, the term of this patent is extended or adjusted under 35 U.S.C. 154(b) by 0 days.

(21) Appl. No.: 16/616,128

(22) PCT Filed: May 8, 2018

(86) PCT No.: PCT/IB2018/053188

§ 371 (c)(1),
(2) Date: Nov. 22, 2019

(87) PCT Pub. No.: WO2018/224898

PCT Pub. Date: Dec. 13, 2018

(65) Prior Publication Data

US 2020/0108652 A1 Apr. 9, 2020

(30) Foreign Application Priority Data

Jun. 9, 2017 (BE) ..... 2017/5416

(51) Int. Cl.
*B42D 5/00* (2006.01)
*B42D 5/02* (2006.01)
(Continued)

(52) U.S. Cl.
CPC ..... *B42C 5/00* (2013.01); *B31F 1/08* (2013.01); *B42C 5/02* (2013.01); *B42C 5/04* (2013.01);
(Continued)

(58) Field of Classification Search
CPC .... B42C 5/00; B42C 5/02; B42C 5/04; B42C 5/06; B42C 19/02; B31F 1/08
(Continued)

(56) References Cited

U.S. PATENT DOCUMENTS 2,245,891 A * 6/1941 Ackley ..... B42B 2/00 281/21.1
10,369,830 B2 8/2019 Peleman
(Continued)

FOREIGN PATENT DOCUMENTS

| | | |
|---|---|---|
| EP | 2295261 A1 | 3/2011 |
| EP | 2917040 B1 | 9/2016 |
| WO | 2014/072778 A1 | 5/2014 |

OTHER PUBLICATIONS

International Search Report and Written Opinion, dated Jun. 19, 2018, from corresponding PCT application No. PCT/IB2018/053188.

*Primary Examiner* — Kyle R Grabowski
(74) *Attorney, Agent, or Firm* — Nixon & Vanderhye

(57) ABSTRACT

Disclosed is a method for binding a bundle of leaves, of which a strip of each of the leaves is folded separately beforehand along a first line to form a first fold line that extends parallel to and at a first distance from the edge, and subsequently is folded again along a second line to form a second fold line that extends parallel to and at a second distance from the edge whereby the first distance is different from the second distance.

18 Claims, 4 Drawing Sheets

(51) Int. Cl.

| | |
|---|---|
| ***B42D 5/04*** | (2006.01) |
| ***B42D 5/06*** | (2006.01) |
| ***B42C 19/02*** | (2006.01) |
| ***B31F 1/08*** | (2006.01) |
| ***B42C 5/00*** | (2006.01) |
| ***B42C 9/00*** | (2006.01) |
| ***B42D 1/00*** | (2006.01) |
| ***B42C 5/02*** | (2006.01) |
| ***B42C 5/04*** | (2006.01) |
| ***B42C 5/06*** | (2006.01) |

(52) U.S. Cl.
CPC ..... *B42C 5/06* (2013.01); *B42C 9/0056* (2013.01); *B42C 19/02* (2013.01); *B42D 1/002* (2013.01)

(58) Field of Classification Search
USPC ..... 281/40
See application file for complete search history.

(56) References Cited

U.S. PATENT DOCUMENTS

| | | | | |
|---|---|---|---|---|
| 2005/0276678 | A1* | 12/2005 | Hawley | B42D 1/006 412/1 |
| 2012/0169036 | A1* | 7/2012 | Huotari | B42D 13/00 281/2 |
| 2015/0283843 | A1* | 10/2015 | Peleman | B42C 5/00 412/4 |
| 2019/0299694 | A1 | 10/2019 | Peleman | |

* cited by examiner

METHOD FOR BINDING A BUNDLE OF LEAVES

BACKGROUND OF THE INVENTION

Field of the Invention

The present invention relates to a method for binding a bundle of leaves, for example to form a book or similar, in particular to obtain a book or folder whose leaves can be opened flat and the printing continues seamlessly over the two opened leaves. This last aspect is particularly desired for composing books of photographs, magazines and similar, with photographs and illustrations that run over the entire width of the opened book.

Description of the Related Art

A method as specified in EP2917040 is already known, whereby the bundle is placed in the binding back with an edge of the leaves and fastened therein, whereby for the binding use is made of a bundle of leaves of which a strip of each of the leaves has been separately double folded beforehand along the exact same line to form a fold line that extends parallel to and at a distance from the aforementioned edge.

Double folded means that the strip is first folded in the one direction and then is folded in the other direction, and this along the exact same line.

One direction means the direction of the top of the leaf or to the front flap. The other direction means the direction of the bottom of the leaf or to the back flap.

An advantage of such method is that the fold line enables the leaves to be folded out along this fold line when the book is opened, and that when the bundle of leaves is bound in the back, the leaves lie with their sharp fold lines against one another, so that the leaves can be opened flat and that printing can continue across the opened leaves as good as seamlessly over two adjacent fold lines.

Another advantage is that when the bundle is opened there is no split between the opened leaves, so that the adhesive or stitching or staples that are used to bind the bundle in the back are not visible and thus do not disturb the printing that runs from the one leaf to the other leaf.

A problem that occurs relates to the durability and the formation of tears along a fold line after intensive turning of the leaves.

SUMMARY OF THE INVENTION

The purpose of the present invention is to solve this problem and also to provide an increased user experience.

An aspect of an increased user experience relates to the fact that the position of a leaf in a bundle partly determines how many leaves come before the leaf concerned, and how many leaves come after the leaf concerned.

In this way for example the penultimate leaf of a bundle, on opening the bundle at this position whereby the penultimate leaf lies directly or indirectly against the back flap of the bundle, has only one leaf after it.

When that penultimate leaf is turned, such that it lies indirectly against the front flap of the bundle, practically the whole bundle of leaves precedes this penultimate leaf.

This illustrates that depending on the position of a leaf in a bundle the ideal hinge or fold lines or turn lines of the leaf concerned, turned toward the front flap and the one turned toward the back flap, are different. Between the different leaves in the bundle in relation to each other, these ideal turn lines are also different in principle.

The object of the present invention is a method for the binding of a bundle of leaves in a binding back, whereby the bundle is placed in the binding back with an edge of the leaves and fastened therein, whereby for the binding use is made of a bundle of leaves of which a strip of each of the leaves has been separately folded beforehand along a first line to form a first fold line that extends parallel to and at a first distance from the aforementioned edge, and subsequently is folded again along a second line to form a second fold line that extends parallel to and at a second distance, other than the first distance from the aforementioned edge such that the first distance is different from the second distance.

Consequently, two fold lines are created at a distance from each other.

An advantage of such a method is that the fold lines enables the leaves to be folded out along these fold lines when the book is opened, and that when the bundle of leaves is bound in the back, the leaves lie with their sharp fold lines substantially against one another, such that the leaves can be opened flat and that printing over the two adjacent fold lines can continue as good as seamlessly across the opened leaves.

In a certain embodiment the fold lines are so close together that it is practically impossible to notice that there are several.

Another advantage is that when the bundle is folded open frequently, there is no weakening or wear and tear on the fold lines, as the folding is divided over several fold lines.

In a preferred embodiment of a method according to the invention a strip of each of the individual leaves is folded beforehand in a first direction along a first line to form a first fold line that extends parallel to and at a first distance from said edge, and subsequently is folded again along a second line to form a second fold line that extends parallel to and at a second distance from said edge.

Preferably the first and second direction are different, for example the first direction folded to the top of the leaf and the second direction to the bottom of the leaf. The directions can also be the same, whereby via two fold lines the leaf is always folded to the top.

Preferably the distance at which the first fold line and the second fold line lie from each other is a fraction of a millimetre to a few millimetres.

In a certain embodiment of a method according to the invention a strip of each of the individual leaves of the bundle is double folded along a certain fold line.

In yet another embodiment of a method according to the invention a fan of fold lines is formed by adding a third, fourth, etc. or more fold lines each time along another line that extends parallel to and at least at a distance from said edge and lies at a distance from the previous and any other fold lines.

Consequently, three or more fold lines are formed, like a broad fan closely next to each other. This can be advantageous if a leaf or bundle has to bridge a large fold distance. With several fold lines the fold will fall very flexibly.

In a special embodiment of a method according to the invention one or several fold lines of consecutive leaves in the bundle lie at a different distance from the edge depending on the position of the leaves in the bundle.

Indeed, the first leaves in a "thick" bundle lie closer against the front flap than the last leaves in the bundle, as do the leaves that lie against the back flap, albeit that the first leaves then lie further from the back flap than the last leaves. Here it can be advantageous to lie the fold line for the folding to the front flap closer against the edge for the first leaves than for the last leaves, or the other way around further from the back flap for the first leaves than for the last leaves.

Preferably use is made of a bundle of leaves of which the strip of the leaves is folded back into the plane of the leaves.

Preferably the angle over which the strip is folded is greater than 90°. Thus, a nice folding and not a mere bending is obtained.

Even more preferably, the angle over which the strip is folded is at least 120°, or even 180°.

As a result, the binding will proceed smoothly, accurately and easily and this in the same traditional way as a conventional bundle without folded leaves.

Preferably the distance between the fold line and the edge of the leaves is chosen such that when opening the bound bundle, the opened leaves are flat or practically flat.

Flat here means that the plane of the one leaf is in the plane of the other leaf, such that the set of two leaves extends in one plane such that the set of two leaves can be considered as flat or practically flat.

This will facilitate the reading of the text printed on the leaves for example, because they do not bulge up on the binding side. With photographs that are printed on the leaves, the absence of bulging of the leaves on the binding side will increase the aesthetic character.

According to a preferred characteristic the binding back is a V-shaped or U-shaped binding back and the distance between the fold line and the edge of the leaf essentially corresponds to the depth of the binding back, whereby this distance is preferably somewhat greater than the depth of the binding back.

This has the advantage that at the level of the fold line the leaves can be folded over the binding back when the bundle is fastened in the binding back.

According to a preferred characteristic said distance is between 10 and 14 mm and preferably 12 mm According to a preferred characteristic the binding back is a metal binding back that is provided with a hotmelt adhesive that is made to melt during binding in order to fasten the leaves along their aforementioned edge after solidification.

An advantage of this is that this method enables the bundle to be fastened in the binding back in a fast and practical way. Because the leaves fold open at the level of the fold line, when the bundle is opened the adhesive at the edge will not be visible.

Preferably the arms of the metal binding back are squeezed together after placing the bundle in order to clamp the bundle in the binding back.

This has the advantage that the bundle is firmly anchored in the binding back. Moreover, the squeezed binding back will hold the leaves together when the bundle is opened, such that the fold lines of the leaves lie against one another and in addition, there will be no split between the bundle and the edges of the arms of the binding back, such that adhesive and similar are concealed from view.

According to a preferred characteristic, the bundle is stapled before binding.

An advantage of such a method is that in principle no adhesive is necessary to hold the bundle in the binding back, it is sufficient to place the stapled bundle in a binding back and then to squeeze the binding back closed such that the bundle is clamped in the binding back.

According to a preferred characteristic the leaves are first provided with printing that continues up to the closest fold line.

According to a preferred characteristic the sides of adjacent leaves facing each other are first provided with printing that continues over the fold line of both leaves, as it were seamlessly, from one side to the other side to which end the part of the printing on one side is applied up to the fold line of the leaf concerned and the part of the printing on the other side is applied up to the fold line of the adjacent leaf.

An advantage of this is that the printing, for example a photograph, can run across two sides of adjacent leaves. Moreover, the printing does not have to continue up to the aforementioned edge, such that printing of the leaves is easier.

Preferably the printing on one side and the printing on the other side continue with an overlapping part over the fold line.

This has the advantage that when the bundle is opened no thin unprinted line will be visible at the level of the fold lines, when for example a small deviation or inaccuracy has occurred during the prior double folding of the leaves or during the binding of the bundle.

In a preferred embodiment one or two endpapers of a folder or book are affixed in the binding back.

This endpaper has the advantage that it will protect the printing on the outermost side of the outermost leaves of the bundle against damage or wear.

Preferably the endpapers can be folded completely outwards with respect to the arms of the binding back, up to against or almost against the arms of the binding back.

This will ensure that the binding back can be turned around an axis that is parallel to the fold line when leafing through the bundle.

As a result of this, the pages will lie flat while leafing through the bundle.

The invention also relates to a bundle of leaves, whereby a strip of at least a part of the individual leaves is folded beforehand along a first line to form a first fold line that extends parallel to and at a first distance from said edge, and subsequently is folded again along a second line to form a second fold line that extends parallel to and at a second distance from said edge whereby the first distance is different from the second distance.

The invention also relates to a bundle of leaves, whereby a strip of at least a part of the individual leaves is folded beforehand in a first direction along said first fold line, and subsequently in a second direction along said second fold line whereby the first and the second direction are different.

Preferably the distance at which the first fold line and the second fold line lie from each other is a fraction of a millimetre to a few millimetres. Preferably the fold lines are very close to each other.

In a certain embodiment of a bundle of leaves according to the invention a strip of each of the leaves of the bundle is individually double folded along a certain fold line.

In another embodiment of a bundle of leaves according to the invention the bundle of leaves comprises a fan of fold lines by adding a third, fourth, or several fold lines each time along another line that extends parallel to and at least at a distance from said edge and which lie at a distance from every other fold line.

As the case may be, however not necessarily, because possibly the second fold line of a first set of fold lines coincides with the first fold line of another set of fold lines.

Preferably the leaves of the bundle are flat, because the strip of each leaf is folded back separately to the plane of the leaf and said distance is between around 10 and 14 millimetres.

It is not excluded that this distance is greater, for example 15 or 20 millimetres.

Furthermore, the invention relates to a book or folder with a binding back and a bundle of leaves bound therein, whereby the bound bundle is a bundle according to the invention.

BRIEF DESCRIPTION OF THE DRAWINGS

With the intention of better showing the characteristics of the invention, a preferred method for binding a bundle of leaves according to the invention is described hereinafter, by way of an example without any limiting nature, with reference to the accompanying drawings wherein:

FIG. 6 schematically shows the bundle while being leafed through; and

DESCRIPTION OF THE PREFERRED EMBODIMENTS

Figure 1:
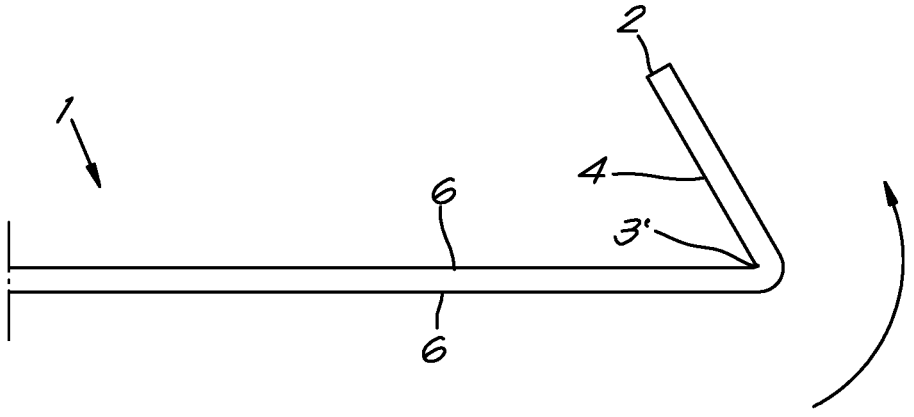
FIGS. 1 to 5 schematically show the consecutive steps of a method according to the invention.
Figure 2:
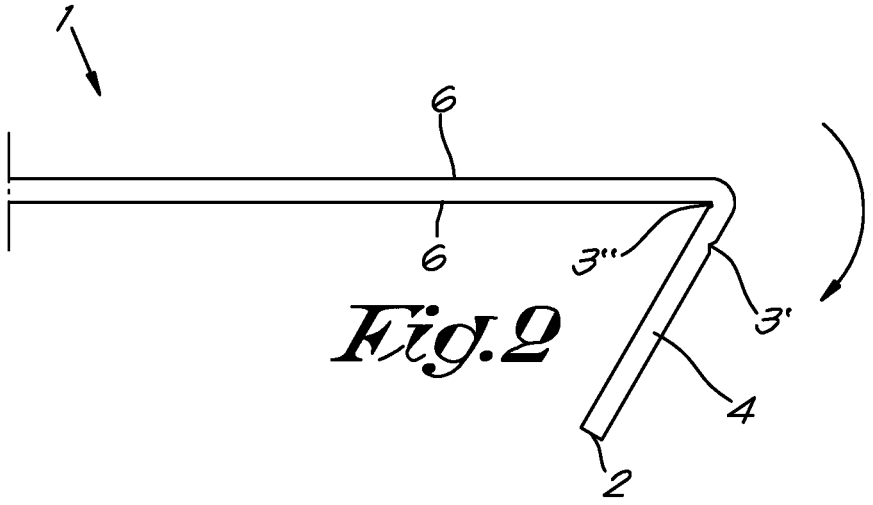
Figure 3:
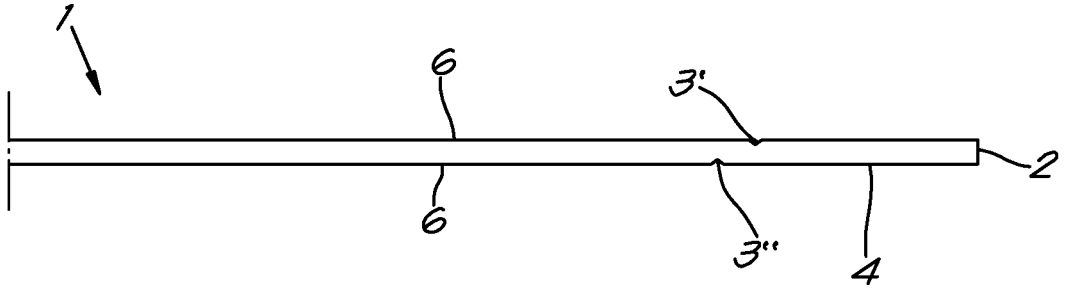

FIGS. 1 to 3 schematically show a method for the manufacture of a leaf 1.

To this end a leaf 1 with an edge 2 is folded along a fold line 3', which runs parallel to the edge 2 and at a distance A from it, in one direction, to the top of the leaf, as shown in FIG. 1. In this way a strip 4 is formed that is delimited by a fold line 3'.

The strip 4 is then folded in the other direction, along the bottom of the leaf, according to the sharp fold line 3" as shown in FIG. 2.

Thus, the strip 4 contains two fold lines 3', 3", each as a result of a prior folding in another direction, as shown in FIG. 3.

The strip 4 is folded each time over an angle of at least 90°, preferably 120°, as shown in FIGS. 1 and 2.

However, it is not excluded that the angle over which the leaf 1 is folded is greater than 120°.

Folding the leaf 1 over an angle greater than 90° and preferably at least 120° has the advantage that the leaf 1 will fold over the formed fold line 3', 3". When the angle is less than 90°, the leaf 1 will bend around the fold line 3', 3".

In this way a leaf 1 is folded in two directions each time along a different fold line. In this example the leaf 1 has two fold lines 3', 3" which lie at a close distance from each other, typically a fraction of a millimetre to a couple of millimetres. This difference in distance is barely noticeable.

Preferably the strip 4 for forming the fold lines 3', 3" is folded completely flat. In this way the fold lines 3', 3" form as it were a flexible hinge along which the leaf 1 can be flexibly turned back and forth with respect to the strip 4.

The distance A between the edge 2 and the fold line 3" closest to the edge 2 is practically equal to the width of the strip 4.

Figure 4:
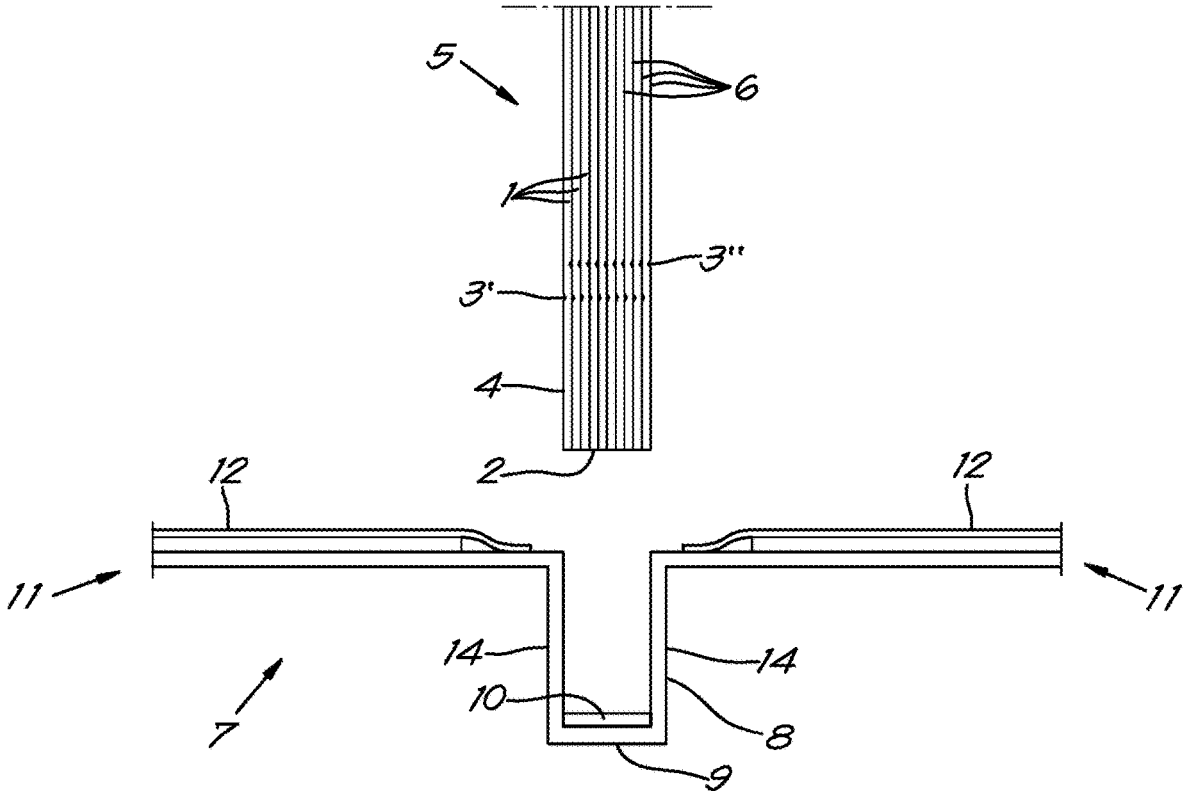
Figure 5:
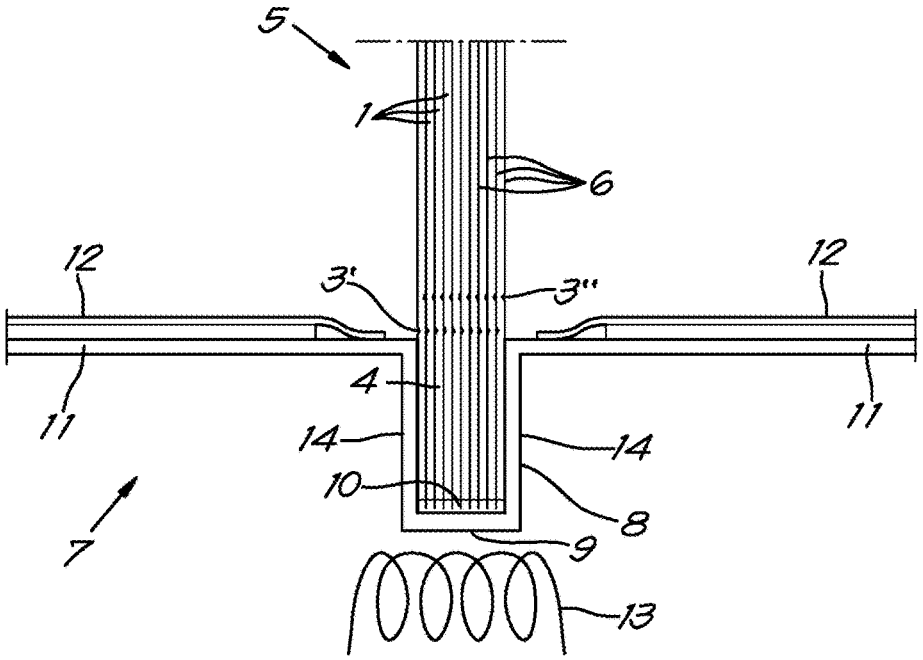
Figure 6:
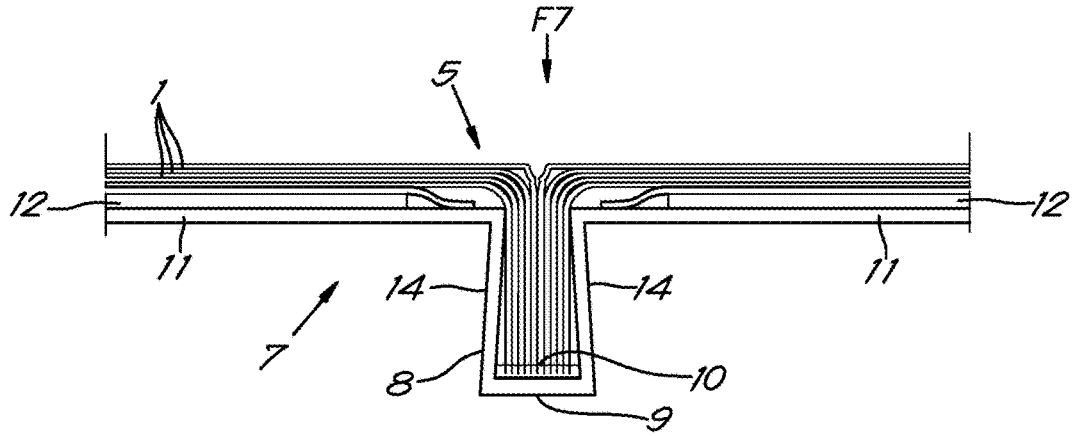

FIGS. 4 to 6 schematically show a method for binding a bundle 5 of leaves 1. In reality the distance between the fold lines 3', 3" is smaller than shown in the figures.

As shown in FIG. 4, the bundle 5 consists of a number of pre-folded however essentially reflattened out leaves 1, as shown in FIGS. 1 to 3, that are placed with their sides 6 against one another, whereby the edges 2 of the leaves 1 to be bound are aligned with respect to one another.

In this case the binding back 7 consists of a U-shaped part 8, for example of metal, with a layer of hotmelt adhesive 10 on the base 9.

The binding back 7 is further provided with two endpapers 11, for example of cardboard, that are provided with a covering 12 on either side.

It is clear that the binding back 7 can also take on other forms.

The bundle 5 is placed in the U-shaped part 8 of the binding back 7, whereby the edges 2 of the leaves 1 are placed up against the layer of hotmelt adhesive 10.

Hereby the fold line 3' of the leaves 1 comes out somewhat above the U-shaped part.

Subsequently the layer of hotmelt adhesive 10 is heated by means of a heat source 13. Consequently, the hotmelt adhesive 10 will melt and become liquid, such that the leaves 1 of the bundle 5 can be affixed therein.

After solidification of the hotmelt adhesive 10, the bundle 5 is attached to the bundle 7 via the hotmelt adhesive 10.

Subsequently, the arms 14 of the U-shaped part 8 of the binding back 7 are squeezed together. This will ensure an extra sturdy fixing of the bundle 5 in the binding back 7 and the fit of the bundle 5 against the free edges of the arms 14 without a split being visible between the two.

The bound bundle 5 is now finished into a folder with bound leaves 1.

As shown in FIG. 6, when opening the bundle 5, the leaves 1 folded beforehand will extend in one plane In reality the result is better than shown in the drawings, which give a somewhat distorted picture because a certain thickness has been given to the leaves for clarity.

Figure 7:
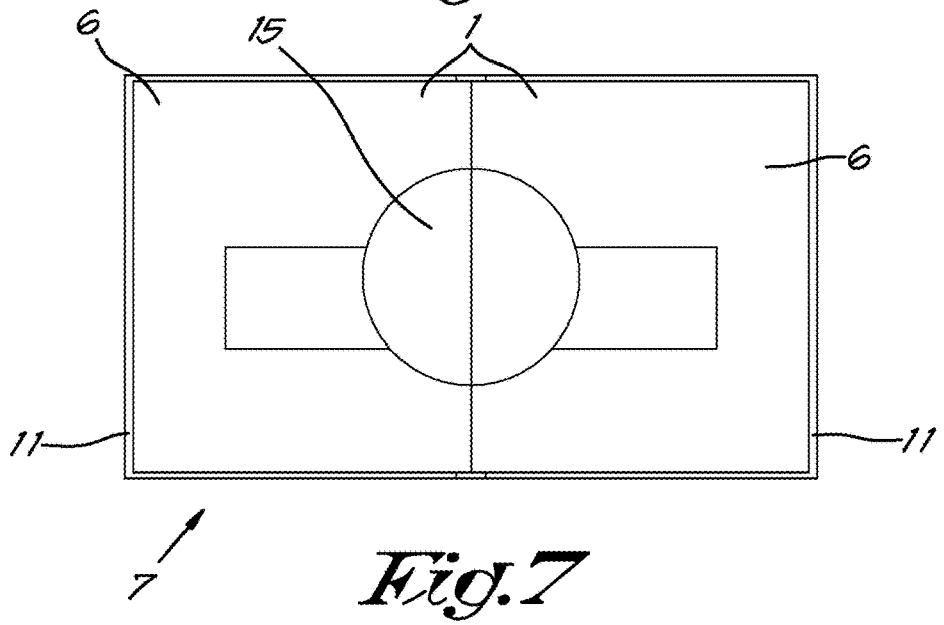
FIGS. 7 to 9 schematically show the folded leaves, but in a loose separated position.

As presented in FIG. 7, the sides 6 of the leaves 1 are printed, for example with a part of an illustration 15 or photograph, whereby the illustration 15 continues practically seamlessly from one leaf 1 to the other leaf 1 to thus form one continuous illustration. This is useful, for example, when composing a photograph album whereby in this way large photographs can be provided that extend over two leaves 1 and this without an inconvenient split between the two.

Figure 8:
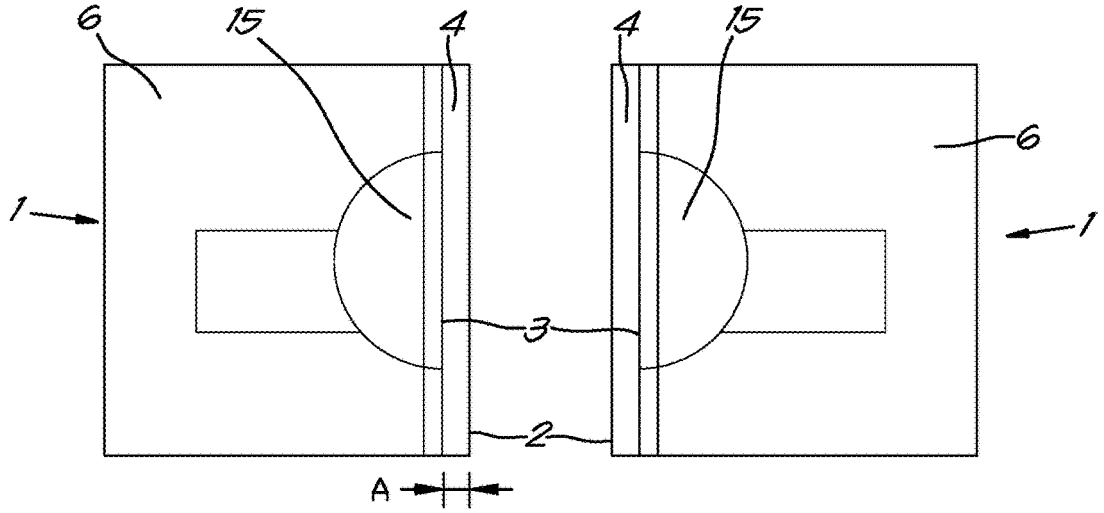

FIG. 8 shows two printed leaves 1, whereby after binding the printing 15 will form one single whole on both leaves 1 together.

Hereby the printing 15 is printed up to the fold line 3' that lies closest to the edge 2, whereby the strip 4 remains unprinted.

Figure 9:
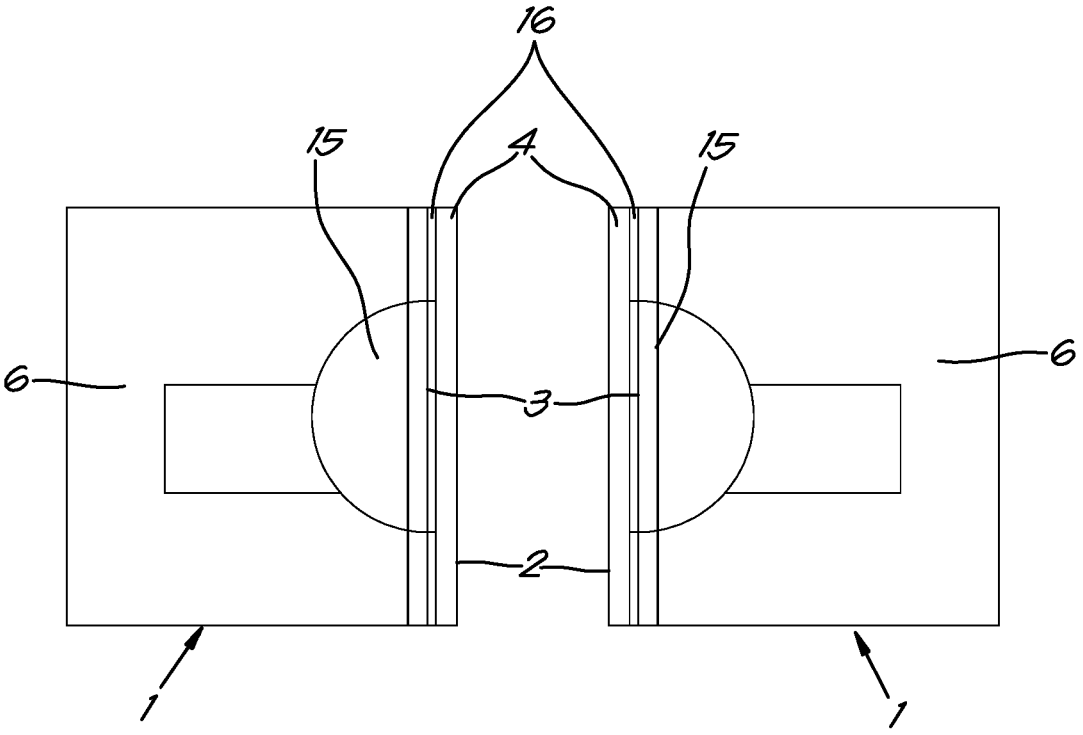

FIG. 9 shows a variant of this, whereby a part 16 of the strips 4 is also printed with an overlapping part of the printing 15.

It is clear that the hotmelt adhesive 10 can be left out, and that the bundle 5 can be stapled before being placed in the binding back 7.

It is also clear that the squeezing of the arms 14 of the U-shaped part 8 of the binding back 7 can be omitted.

The present invention is by no means limited to the embodiments described as an example and shown in the drawings, but a method for binding a bundle of leaves according to the invention can be realised in all kinds of variants, without departing from the scope of the invention.

The invention claimed is:

1. A method for binding a bundle of leaves in a binding back, the method comprising:

individually folding a strip of each leaf of the bundle of leaves in a first direction along a first line to form a first fold line that extends parallel to and at a first distance from an edge of the respective leaf, the first fold line being a first indentation from a first side of the strip into the strip;

subsequently folding the strip again in a second direction different from the first direction along a second line to form a second fold line that extends parallel to and at a second distance from said edge, the first distance being different from the second distance, the second fold line being a second indentation from a second side of the strip opposite the first side into the strip;

unfolding the strip such that the entire strip is coplanar, a planar portion of the strip being provided between the first indentation and the second indentation, the planar portion of the strip between the first and second indentations being coplanar with remaining portions of the strip; and placing the bundle with the edges of each of the leaves in the binding back and fastening the bundle in the binding back.

2. The method according to claim 1, wherein a distance at which the first fold line and the second fold line lie from each other is a fraction of a millimeter to a few millimeters.

3. The method according to claim 1, wherein the strip of each of the leaves of the bundle is individually double-folded along one of the fold lines.

4. The method according to claim 1, wherein one or a plurality of fold lines of consecutive leaves in the bundle lie at a different distance from the edge depending on a position of the leaves in the bundle.

5. The method according to claim 1, wherein the strip of each of the leaves is folded back to the plane of the leaves.

6. The method according to claim 1, wherein the angle over which the strip is folded is at least 120°.

7. The method according to claim 1, wherein the distance between the first fold line and the edge of the leaves is chosen such that, when opening the bound bundle, the opened leaves extend flat or practically flat.

8. The method according to claim 1, wherein the binding back is a V-shaped or U-shaped binding back, and the first distance essentially corresponds to the depth of the binding back.

9. The method according to claim 1, wherein the first distance is greater than the depth of the binding back.

10. The method according to claim 1, wherein the first distance is between 10 and 14 millimeters.

11. The method according to claim 1, wherein the binding back is a metal binding back that is provided with a hotmelt adhesive that melts during binding in order to fasten the leaves along the edges thereof after solidification.

12. The method according to claim 1, wherein the arms of the binding back are squeezed together after placing the bundle in order to clamp the bundle in the binding back.

13. The method according to claim 1, wherein the bundle is stapled beforehand.

14. The method according to claim 1, wherein the leaves have been or are provided with printing beforehand that continues up to one of said fold lines.

15. The method according to claim 14, wherein the printing on one side and the printing on the other side continue with an overlapping part over one of the fold lines.

16. The method according to claim 1, wherein sides of adjacent leaves facing each other are provided beforehand with printing that runs seamlessly over the fold lines of both leaves from one of the sides to another of the other sides to which end the part of the printing on the one side is applied up to the fold lines of the respective leaf and the part of the printing of the other side is applied up to one of the fold lines of an adjacent leaf.

17. The method according to claim 1, wherein one or two endpapers of a folder or book are affixed to the binding back.

18. The method according to claim 17, wherein the endpapers are folded completely outwards with respect to the arms of the binding back up to against or almost against the arms of the binding back.

* * * * *